US005772212A

United States Patent [19]

Hagedorn

[11] Patent Number: 5,772,212

[45] **Date of Patent: *Jun. 30, 1998**

[54] MULTI-FUNCTIONAL ALPHABET CARDGAME W/OPTIONAL DIAMONOIDAL CARDS

[76] Inventor: Rhonda Faye Hagedorn, 14052 Yucca St., Jamul, Calif. 91935

[ * ] Notice: The term of this patent shall not extend beyond the expiration date of Pat. No. 5,524,899.

[21] Appl. No.: 611,568

[22] Filed: Mar. 6, 1996

Related U.S. Application Data

[63] Continuation of Ser. No. 441,424, May 15, 1995, Pat. No. 5,524,899.

[51] Int. Cl.[6] ..... A63F 1/00

[52] U.S. Cl. ..... 273/299; 273/302; 273/308; 434/172; 434/167

[58] Field of Search ..... 273/299, 302, 273/308, 272, 249; 434/172, 167, 159, 171

[56] References Cited

U.S. PATENT DOCUMENTS

| | | | |
|---|---|---|---|
| D. 56,985 | 1/1921 | Moore | 273/299 |
| 1,312,278 | 8/1919 | Shinn | 273/299 |
| 1,557,824 | 10/1925 | Fritz | 273/299 |
| 2,635,360 | 2/1953 | Bishop | 35/73 |
| 3,654,712 | 4/1972 | Bagdasar | 434/172 |
| 4,192,513 | 3/1980 | Feeley et al. | 273/299 |
| 4,262,431 | 4/1981 | Darnell | 434/172 |
| 5,014,996 | 5/1991 | von Braunhut | 273/299 |
| 5,108,113 | 4/1992 | Leach | 273/302 |
| 5,161,976 | 11/1992 | Crowe | 434/159 |
| 5,199,714 | 4/1993 | Harper | 273/299 |
| 5,417,432 | 5/1995 | Dwyer | 273/299 |

OTHER PUBLICATIONS

Jack, Queen & King in an Ordinary Deck of Playing Cards.

*Primary Examiner*—Benjamin H. Layno

[57] ABSTRACT

A youth oriented alphabet learning card game is set forth in several generic-variants, the preferred embodiment featuring a special corner oriented arrangement of alphabetic indicia, in combination with a related key visual picture-pairing object illustration arranged centrally within the card format. Thus, on each individual card a different alphabet character is represented in both upper and lower case ("A" and "a" for example), preferable positioned upper-case immediately above lower-case. Additionally, the particular arrangement of card face graphics is such that it is essentially impossible for a youngster to hold the preferably rectangular cards in manner in which some cards appear confusingly up-side down. An optional diamond card configuration offers the human-engineering advantage of the player's ability to now easily fan cards out at their upward ends to observe each individual alphabet letter, while the lower diamond-tip ends of the cards virtually converge into a V-formation, found more easily held in a small hand. Each alphabet-set or suit of cards is preferably identified via a colored-frame around the central object illustrations, there preferably being two suits to a game. The redeeming quality of the game residing in it's teaching of the alphabet, matching of objects, counting, phonics, spelling, and training of memory;—all without the learner experiencing boredom common in learning concentration disciplines.

14 Claims, 2 Drawing Sheets

MULTI-FUNCTIONAL ALPHABET CARDGAME W/OPTIONAL DIAMONOIDAL CARDS

This application is a continuation of application Ser. No. 08/441,424 filed on May 15, 1995 now U.S. Pat. No. 5,524,899.

FIELD OF THE INVENTION

The present invention pertains to card games. Specifically, the present invention pertains to a card game employing the alphabet and graphical cues wherein each card includes one character from the alphabet and a graphical cue to assist the player in identifying the character.

BACKGROUND OF THE INVENTION

This invention relates to multi-player game inventions, including multi-suit or 4-"suit" (13-cards per suit) 52-card "deck" card games, and more particularly relating to those types of card games employing alphabet characters; and additionally, the elementary teaching of an orderly sequencing of such alphabet characters to form words via use of supplemental alternate-symbol indicia.

Heretofore, inventors have contrived various ways of utilizing the notion of compact hand-held deck-cards to achieve an entertaining socially-interactive genera, as well as for educational purposes. Background research discovery provides some interesting prior patent-art regarded as germane to this disclosure.

Chronologically for example U.S. Pat. No. 1,312,278 (filed November 1918) shows an early alphabet card-game having twenty-six cards bearing clue pictographs associating a particular letter of the alphabet with an appropriate object (such as "M" for "mask" or "mill"); plus, any number of additional playing-cards bearing an alphabet-font character only. The game-plan is such that the person correctly spelling the most objects before the cards are exhausted therefore wins.

In U.S. Pat. No. D56,985 (filed: January 1921) an early ornamental graphic-design for a set of playing-cards is shown. To that extent, there are 26-pictographs displayed individually along with an appropriate alphabet-character depicted the first letter in the spelling of that illustrated object, including complete spelling for that pictograph object is shown;—plus an "ABC" graphic-design for the back-sides thereof. Therefore, there is no apparent game-plan nor contemplation indicated for "pairing" of these playing-cards, and the cards can inadvertently appear upside-down to the player.

In U.S. Pat. No. 1,557,324 (filed: February 1923) shows an early word-forming card game having two suits of 26 cards representing all the letters of the alphabet, including optional clue-object pictographs such as animal-head represented in phantom-outline upon alphabet-font card -"A," the player thus said to ostensibly associate "animal" with the character "A." Hence, while the notion of providing a pictograph object, the name of which corresponds to the alphabet-font both shows on the front-side of the card,—the game plan is nevertheless all together different (and the cards can inadvertently appear upside-down to the player). For example, the inventor differentially teaches that: a.) to "pair" has no contemplated significance in the game; b.) the inventor employs two identical card-suits, but for the only purpose of convenience in spelling words; c.) the inventor only employs pictographs in a "non-specific" arbitrary sense, in as much as his FIG. 2 example, showing "A" stands for "animals" (not "H" for Horse), thus "Z" could not really stand for "Zebra" because all animals were broadly covered via the letter-font "A"; d.)the inventor states that a player can "call out Horse" whereupon an opponent if in possession of an "H" card, will place such cards on the table, along with "O"-card etc. if available (but it is presumed in this instance that when employing the non-pictographed cards of the FIG. 1 the example.)

U.S. Pat. No. 2,635,360 (filed: February 1950) is an educational apparatus employing use of playing-cards having an upper-case alphabet-character appearing centered on the obverse-side, and a matching lower-case alphabet-character likewise appearing centrally upon the reverse-side. A vertically-tiered shelf-workboard is included for placement of these playing-cards in sequencing as desired to spell words; but no game-plan is contemplated.

In U.S. Pat No. 3,654,712 (filed December 1969) a hand-portable spelling kit is shown, and as such contemplates no "pairing" procedure; and the pictographs are displayed upon the back-side of the card opposite to the alphabet-character displayed on the front-side for example. The object of the alphabet-kit is to enable the student to arrange letters in a provided display-tray, that the student may readily uphold their selected arrangement of alphabet-characters for a teacher to examine in a busy classroom environment (without the time consuming procedure of having to decipher a student's difficult handwritten scrawling).

In U.S. Pat. No. 4,192,531 (filed: April 1978) a more relevant disclosure sets forth playing-cards having a 4-point diamond configuration wherein both the upper and lower case of alphabet characters are oppositely imprinted in side-by-side fashion near both narrowed outer-ends of the cards;—such as Aa, Bb through Zz. No two cards are graphically alike, and it is claimed that each card has a first and second vertical corner (narrow points), plus a first and second horizontal corner (wide points), in which the length of the card between it's vertical corners is greater than the width of the card between it's horizontal corners;—and the length is about twice that of the width. Plus, there are preferably 26-cards in each of 4-suits, with the second-letter (middle-letter) of a three-letter sequence arranged centrally upon the cards delineating enlarged letters of the alphabet A–Z.

In U.S. Pat. No. 4,262,431 (filed: February 1979) is shown a rather complex word-building teaching-aid in particular feature playing cards having clue pictographs (ref. FIG. 7 detail) in combination with an appropriate alphabet-font character. The invention includes a carry-case arranged with three tiered drawers holding 3-dimensional color-coded letters, and on another side with the plurality of eighteen vertically spaced apart leaf-hinged clue-pictograph cards; but there is no game per se.

In U.S. Pat. No. 5,014,996 (filed: October 1989) a playing-card-word game is set forth, in which a capital-letter of the alphabet is included in both diagonal upper-left/lower-right corners of each card, so as to thereby assemble letters to form a word; whereupon different point-values are totaled from the particular cards used to form a word.

In U.S. Pat. No. 5, 108,113 (filed: December 1990) and educational "phonics" playing-card game for pre-schoolers is set forth, which is conceptually relatively complex; wherein cards are delt to each player, and another to the middle of the table. There are provided eight decks of cards;—the cards exhibiting an upper-case letter comprise two decks, the cards exhibiting a lower-case letter comprise a single deck;—then there are short-vowel and long-vowel word cards, both being elongated in shape, each having a single deck; plus, there is a deck having a shorter matching set of short or long vowel words; and a deck of cards exhibiting words having one or more syllables. There are eighty-four upper-case letter cards, three for each letter of the alphabet;—plus, three extra W and Y cards each. The decks divide the alphabet in half;—the first half, A–M containing 39-cards, the second-half N–Z containing 45-cards. One point is earned when a player audibly correctly pronounces a given letter group, and 6points earns a star;—the player with the most stars thus winning.

In U.S. Pat. No. 5,199,714 (filed: April 1991) a method of playing a Klondike-solitaire word-construction card game is shown,—comprising 52-cards, 50 of which exhibit a single large letter of the alphabet centered thereon. The two blank wild-cards representing any letter of the alphabet desired;—words may be assembled vertically on a single column, or somewhat diagonally across.

In U.S. Pat. No. 5,161,976 (filed: December 1991) an alphabet teaching playing-card game having 50-cards (2-groups of 25-cards) for at least 2-players is set forth; the purpose of which being, to learn the fundamental order of letters in the alphabet. The cards exhibit a single upper-case letter on each side, side-1 for example showing an "A" (preceding), side-2 showing a "B" (succeeding), and so on; whereby the player is required to announce that alphabet-letter (preceding/succeeding) obverse to that which they are shown. The first player to announce a predetermined number of points, such as 26, becomes the winner.

In U.S. Pat. No. 5,417,432 (filed: March 1994) is shown an alphabet playing-card game comprised of 52-cards of two identical suits (distinguished via two different color markings), including optional alphabet-font character associative clue pictographs thereon each card. There is no provision to negate confusingly inverted (180 degree rotation) card reading, nor is there contemplation of over/under arrangement of upper/lower alphabet-font characters in the card corner; although a game plan involving paring combinations of like alphabet or pictograph cards is provided.

Additionally, reference is given to the three well known "Jack/Queen/King" graphic representations traditionally embellishing orthodox sanctioned playing-cards; noting that the motif is essentially divided horizontally along its central median, but limited to these three particular cards only. The purpose of this arrangement being to obviate inadvertent 180-degree upside-down appearance which could otherwise cause some graphic confusion; however, these incarnations are not to be construed as object clue pictographs giving hint as to words associated with alphabet-font characters.

Therefore, in full consideration of the preceding patent review, there is determined a need for an improved form of device to which these patents have been largely addressed. The instant inventor hereof believes their new educational playing-card game method, commercially referred to as the PAIR!! OR NOT!!™, currently being developed for production under auspices of the Haqedorn-Mfg./Mkt.Co., exhibits certain advantages as shall be revealed in the subsequent portion of this instant disclosure.

SUMMARY OF THE INVENTION

A) In view of the foregoing discussion about the earlier invention art, it is therefore important to make it pellucid to others interested in the art that the object of the instant invention is to provide an alphabet based playing-card game combining fast action, chance, and skill, for unpredictable results;—in addition to promoting group-play social interaction, and friendly competition. The entertaining procedures involved in playing this educational game function to combat illiteracy in a diverting nonthreatening fashion, while sharpening spelling and phonics abilities, as well as engendering a modicum of fundamental arithmetical counting operations.

PAIR!! OR NOT!!™ can serve to reinforce positive goals, engender spelling and speaking skills, sharpen letter-recognition, and promote feelings of joyful achievement in youngsters, while facilitating an alternative to video or arcade-style amusements which are generally more physically than cerebrally stimulating. The game accommodates variations to oblige two to six players, gaining or perhaps already possessing some basic skills, and it's deck of 52-cards parallelpied sided planer cards may be conventionally sized for production on standard playingcard production-lines, out of standard durable card-stock. The typically pocket-portable cards are preferably imprinted with vivid full-color art work, and can be even more durably laminated to resist handling and premature-ware such as would be imposed in a school classroom.

B.) Another object of this invention is to provide parents of young children, as well as Day-care Center professionals, an inexpensive device which is safe to handle (no product use insurance liability) and exhibits profoundly easy readability;—the prime functionality of which essentially resides in a simply novel over-under arrangement of the alphabet fonts. The instant inventor's copyrighted graphic alphabet arrangement, although not absolutely required to perform the game, is demonstrated to be much preferred in clinical-lab tests conducted around the invention. Showing that the familiar side-by-side arrangement of upper-case and lower-case alphabet-fonts poses both a visual-acuity and physical-spatial problem, the special over-under arrangement of upper/lower-case alphabet-fonts is by far and away the more efficiently juxtaposed format.

For example, with the conventional side-by-side arrangement, three playing-cards held in one's hand (especially the small hand of a young child) become confusing to the observer, since reading the mixed upper/lower-case format spells out the word "cat" to appear as: "Cc Aa Tt". In marked contrast, in the much more legible over-under format, the word "cat" appears as: "C A T" in pure upper-case fonts,—while immediately thereunder is included the lower-case fonts appearing as""c a t". This interesting characteristic quality of format presentation is represented very clearly in the accompanying invention illustrations. This appears to be a very important discovery in making learning more receptive to virtually anyone, but particularly among youngsters whose developing mind/eye-coordination can synthesize letter by letter spelling much more effectively when the non-confusing over-under font format is employed. Nevertheless, the stated conventional side-by-side format also remains compatible with the general procedural play-value precepts of this invention.

C.) Another object of this fast-action playing-card invention resides in it's ability to maintain children's interest, and stimulate the memory faculty more effectively, than conventional alphabet related teaching methods. The game is preferably played with a 52-card deck of special cards, which are exchanged among the players in order to create sets of matches! Through this modal, children more easily develop interactional skills and deductive reasoning;

—all the while experiencing friendly competition. The novel graphic-design of the cards makes it easy for young children to play, even if they don't yet know the alphabet (that is, have not memorized the orderly sequence of the different twenty-six alphabet-letters). Rather amazingly, even children generally as young as 1-year-old's have been found to readily learn the different graphic object depictions appearing upon the cards, such as: A-apple, B-boat, C-cat, D-duck, E-egg, F-fish, G-goat, H-hat, I-igloo, J-jacks, K-key, L-lion, M-mouse, N-nest, O-octopus, P-pig, Q-queen, R-rabbit, S-snake, T-turtle, U-umbrella, V-violin, W-wagon, X-xylophone, Y-yoyo, Z-zebra.

Children 1½-years and older that don't yet know the alphabet can play by identifying the picture instead of the letter,—learning the alphabet by repetition during the natural course of the game. They learn matching, by matching pairs of letter, or matching pairs of picture-objects or "pictographs". They learn to count by counting their "pairs" after each game. They improve memory capability by remembering a card called for previously by other players; and, memory improves concentration, and enables "pairing" They learn phonics after having learned the alphabet, whereby they can ask for cards by it's individual alphabet-font phonics sounds A–Z, instead of the letter name; thus learning to spell, or sharpen their spelling by playing in the word-game modality.

D.) Another object of the invention is to provide a special graphic format utility which assures the card's alphabet-letter and associated "clue"-picture are always viewed right-side-up;—children are not aggravated by having to rotate cards 180-degrees for correct viewing. Research shows, young children become impatient and annoyed when card images appear upside-down in other card-games.

It has been found that by enclosing the clue-picture object pictograph (a simple illustration for the word: "key" as analogous to the letter 'K' for example) within an organized designated spatial area such as a colored/square-outline or equivalent colored/squared-surround, that paired-matching of the clue-picture objects a player discovers between a suit of 26-cards having red-squares (which in of itself is not herein playable, except as flash-cards), and a deck of 52-cards (playable) having two differently colored squares (A–Z red, and A–Z blue for example) establishes a "pair" (i.e.—two rabbits separately within their different red and blue color-designated spatial areas)! To accommodate older or merely more experienced players, a second differently color-designated deck of otherwise like cards may also be introduce, whereby for example, a third green-square suit and a forth amber-squared suit, are likewise initially well shuffled into the lot as a central draw-pile by an appointed card-dealer, prior to commencing play of the game. Introducing still additional color-designations such as black and purple, does not alter the luck frequency by which a player shall discover their particular pairs of two matching (albeit differently color-designated) picture-objects. Accordingly, for players to change from a "pair"-matching procedure to a quadruplet or "double-pair" matching procedure, shall not be construed as materially changing the object of the game invention; although it does of course, make the luck involved in such protracted matching rather more difficult to accomplish.

Note that for the proceeding game-play example, the preferred color coding technique described is considered best. However, there is no actual play-value advantage to two differently colored suits of a deck when employing only a single deck of cards; and really, other than for visual effect, no actual spatial-window area (square, circle, triangle, etc.) need be included. Naturally, the picture-objects selected here to correspond to a particular alphabet-letter font can vary according to design preference; per example: instead of H-hat, the designation H-heart may be used, instead of D-duck, D-diamond may be used, instead of C-cat, C-circle or C-cow may be used, etc.

E.) Another object of this invention is to provide a more comfortably handled playing-card configuration and particular usage thereof, as compared to the customary conventional vertically arranged rectilinear 4-point playing-card shape. As was earlier discussed in U.S. Pat. No. 4,192,513 which described a diamond-shaped 4-point playing-card, the instant inventor hereof presents a similar diamonoidal shape alternative;—however, further significant adaptation of that configuration is herein taught, facilitating ultimate human-engineering advantage. For example, the said patent consistently taught a conventional side-by-side arrangement of the upper/lower-case letter-fonts at the more narrowly pointed ends of the diamond-shaped card;—while the instant-inventor hereof teaches a novel combination of an over/under graphic arrangement, in combination with an ultimately tightly clustered single V-formation stacking of the more narrow bottom-ends of the diamond-card configuration, while the top-ends are to be uniformity spread-out in fan-clustered fashion so that the over (upper-case preferable)/under (lower-case preferably) arrangement of the letter-fonts may be read in a most natural tightly grouped left-to-right cluster.

F.) Another object of this invention is to provide one or more general game-plans, as follows for example:

1.) —establishing the object of the game is to see who can match the most pairs (that is for example, combining an apple with an apple graphically; or in any case consistently, 2–6players sit in a circle of convenience.) A card-dealer is appointed (usually the oldest person who need not be a player, but an overseeing adult initially), the dealer carefully shuffles all of the cards into a common lot. The dealer then roundly doles-out preferably five-cards to each player in the circle, remaining cards being placed face-down in the common center area, establishing the draw-pile.

The playing Dealer calls "all pais down", then asks any one Player for a specific Letter-font they hold in their hand, thereby holding a card up for all other Players to clearly see, which player then tries to find the matching Letter! If the Player asked has the matching Alphabet-letter themselves, it is then handed to the Dealer. The Dealer then shows all Players the matching Letters, announcing: "PAIR OF - - - " (Letter "A" for example); the Dealer thereby placing the cards in front of themselves.

The dealer then continues, by asking for another Letter from any one Player; if the Player does not have the particular letter in their hand, the Player says: "NOT"! Dealer then draws another card from the draw-pile, and if the card drawn is a match to the Letter just asked for, or a match to any Letter in Dealer's hand, Dealer says: "PAIR OF (say Letter), showing other Players; then placing pairs face-up in front of themselves. Dealer's turn ends when a Player does not have a Letter asked for and a draw-card does not match a Letter in the Dealer's hand. Dealer then saying: "NO PAIRS".

Game then continues on with Player to Dealer's left. When the draw-pile is empty, continue playing until all Players are out of cards. Each Player will count their pairs out-loud, one player at a time, commencing with Dealer;—the Player having the most pairs wins. Note that before the draw-pile is exhausted, if a Player runs our of cards during their play, they must draw three additional cards from the draw-pile and continue playing.

2.) Once the children know the letters of the alphabet, teach them phonics by having them ask for cards by the 'sound' instead of the 'name' of the Letter.

3.) A more spelling oriented generic-variation for PAIR!! OR NOT!!® . . . Dealer passes out preferably 5-cards to each Player, Players then look at their own cards and decide which cards to keep, and the remaining rejected cards are placed face-down, the dealer then replacing them with a like number of new cards. All Players try to spell a word with their respective cards, each card being worth onepoint. For example, "C-A-T" gives 3-points, "F-R-O-G" gives 4-points. Players place such card word spellings in front of themselves. Dealer then shuffles all cards together except for the used word cards. For 2–3 Players, deal five-rounds, for 4–6 Players, deal three-rounds. The Player with the most points at the end of the last round wins! Or,—using a score-pad, reshuffle all cards; the first Player to reach 20-points wins! This version is generally considered more stimulating to players about 6-years of age and older.

BRIEF DESCRIPTION OF THE DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered primarily exemplary and not to be therefore construed as restrictive in nature.

ITEMIZED NOMENCLATURE REFERENCES

10—overall card embodiment
11—perimeter of card
12/12'—upper-case letter-font characters
13/13'—lower-case letter-font characters
14/14' interspatial color-code outlines
15/15' interspatial color-code outlines
16/16' interspatial color-code outlines
17/17' interspatial color-code outlines
18/18'—anterior spaces
19—posterior space
20/20'—picture-object pictograph
21—1st-stack on left
22—2nd-stack from left
23—3rd-stack from left
24—4th-stack from left
25—5th-stack from left
26,26'—A-card transference, B-card transference
27—special stacked convergence point
28—stacked cards with backs facing up
29—subsequent possible further new stack card-A

DETAILED DESCRIPTION OF THE PREFERRED EMBODIMENT

Figure 1:
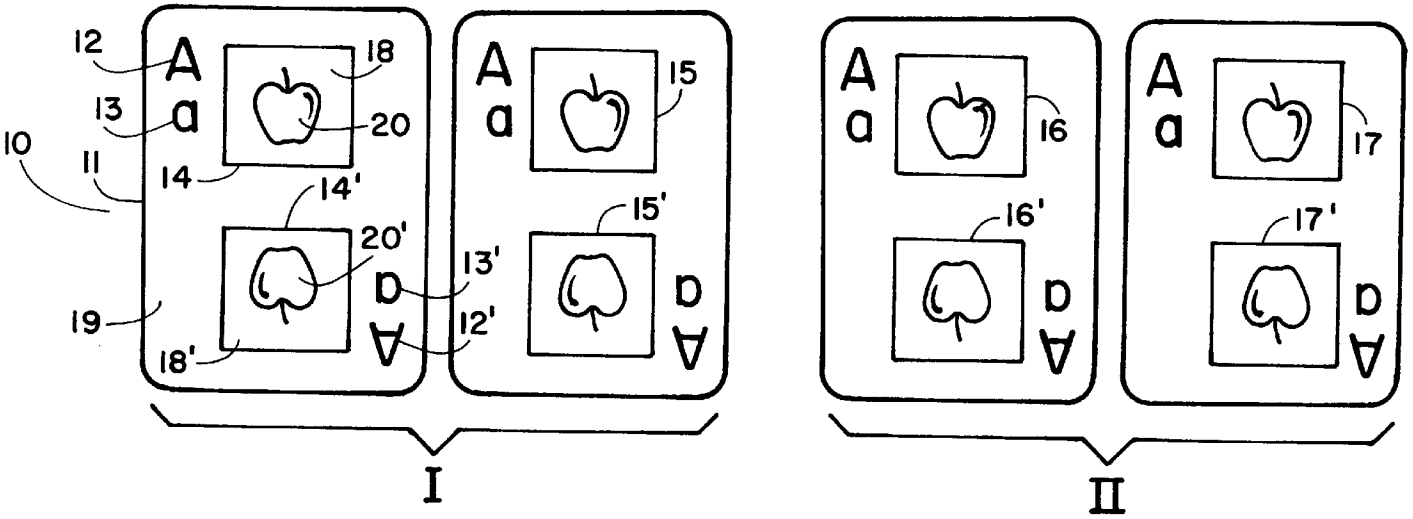
FIG. 1, is a plan-view showing four specially imprinted playing-cards, each representing a full suit of cards equal to two decks of cards, which are preferably identical graphically except for the preferred but optional color-coded interspatial boxes included within the surface field of each card.

Initial reference is given by way of FIG. 1, wherein is exhibited the typically planar four-cornered perimeter configuration obverse-sides of two special playing-card deck stacks referenced I&II, each deck representing 52-cards which further apportion equally into two suit-decks of 26-cards each;—all letter-fonts of alphabet thus appearing once in each suit. The first alphabet-font card 10 (far left) is shown by way of convenience to exhibit an "A" 12 in the upper-left corner of the card, while a like albeit 180-degree "A" 12' is preferably shown inverted in the diagonally opposite lower-right corner. Also shown as a preferred uniquely special graphic arrangement, wherein the lower-case "a" 13 is positioned proximally immediately beneath the upper-case "A" 12, although it is preferred that the upper-case alphabet-fonts be juxtaposed graphically above the lower-case alphabet-fonts rather than the converse arrangement. The lower-case "a" 13' is shown likewise inverted in the diagonally opposite lower-right corner of the playing-card having the full surface field within perimeter parallelogram region 11;—again immediately proximal to the underside of the upper-case "A" 12', it being likewise immaterial other than design preference whether all the upper-case alphabet-fonts be juxtaposed above or beneath the lower-case alphabet-fonts. The two-sequence illustration of FIGS. 2A/B better reveals why this is an important functional advantage. For example, in FIG. 2A the conventional font arrangement reads "Cc-Aa-Tt", which understandably, can be very confusing to a youngster just learning the alphabet. Contrast that with the new font graphic layout arrangement in FIG. 2B, which clearly reads "CAT" in discrete uppercase, and "cat" in discrete lower-case fonts immediately thereunder. Moreover, understand that equally dividing the front-side graphic format transversely along its central horizontal median as shown, thereby essentially exhibits two identical divisional graphic sectors inverted to each other as thus non-centralized clue object pictographs. These pictographs portraying any familiar object, the spelling of which begins with the exhibited alphabet-font character preferably appearing in both upper and lower case incarnations.

Figure 2B:
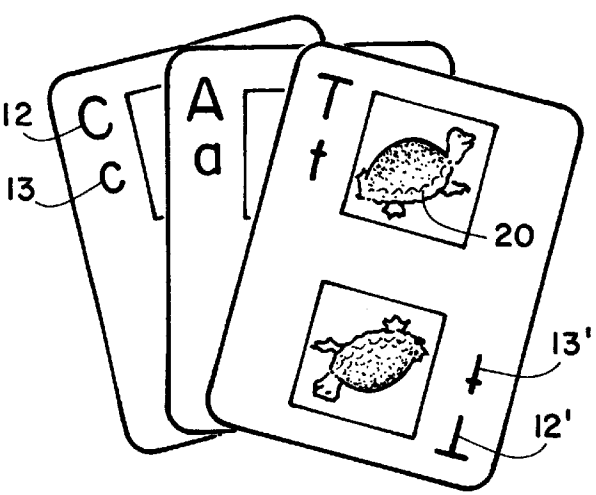
FIG. 2A/B, are similar plan-views comparing the fanned-cluster readability of a conventional graphic sequence of letter-fonts with a special over/under arrangement, the cards perimeter being characterized as rectangular in shape.
Figure 2A:
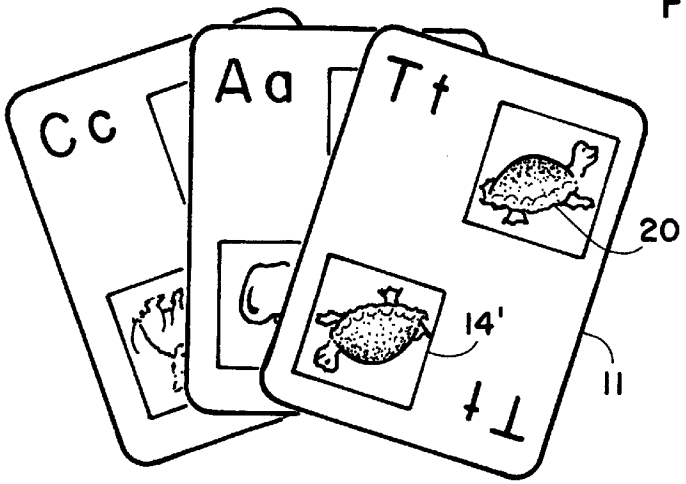
Figures 3, 4, 5:
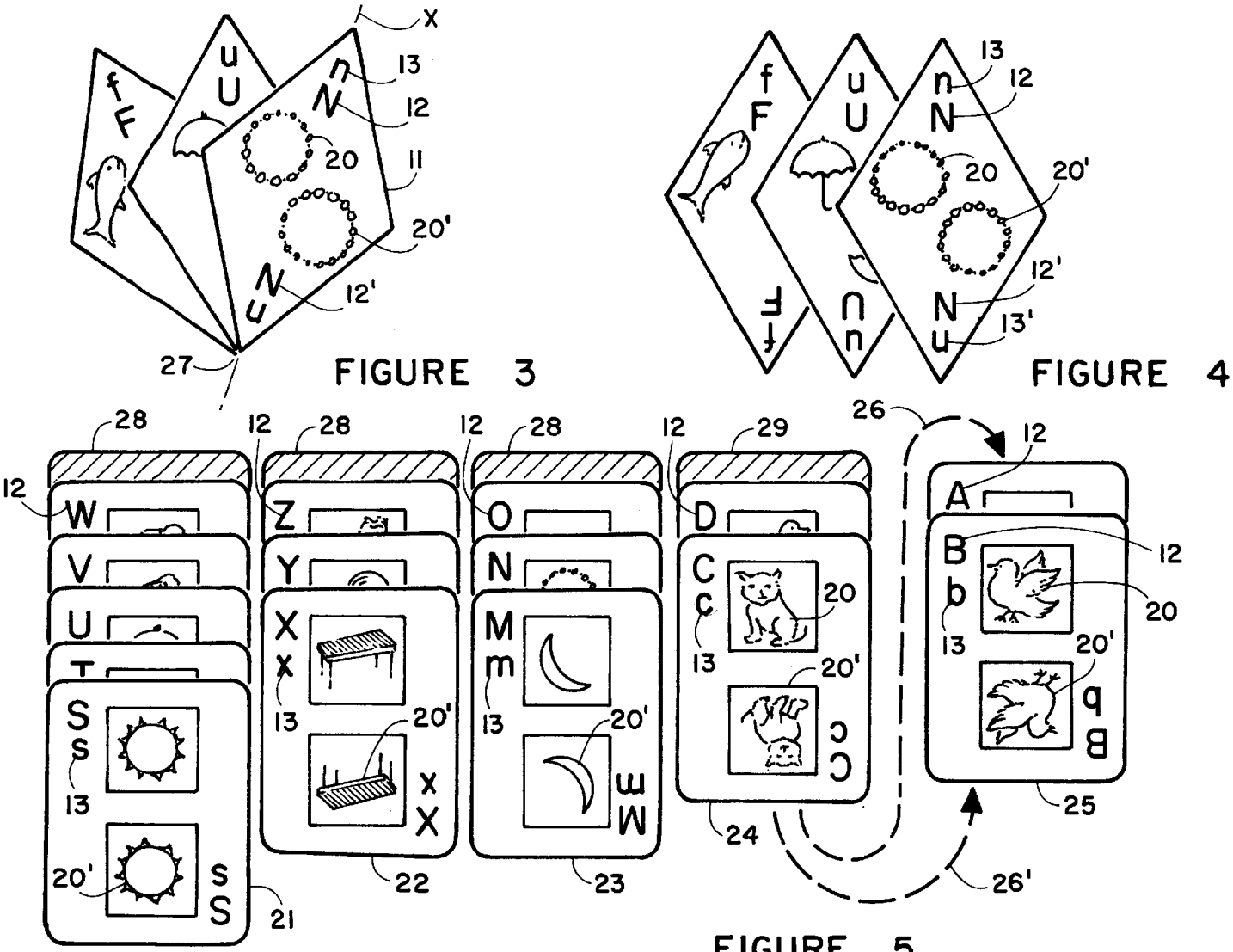
FIG. 3, is another plan-view revealing an ultimately efficient playing-card configuration and graphic-format thereon, the cards perimeter being characterized as diamond in shape.
FIG. 4, is another plan-view demonstrating how the specially configured cards of the game invention may be optionally arranged in laterally overlapped sequence.
FIG. 5, is another plan-view demonstrating how the specially configured cards of the game invention to be arranged in vertical tiers while conducting a game of Solitaire.

Moreover, FIG. 2A illustrates how the conventional side-by-side arrangement of upper/lower-case alphabet letter-fonts can act to adversely confound the player/learner, by the confusing jumbled read of upper/lower-upper/lower-upper/lower-case letter-fonts; which problematically translates in the minds-eye. Conversely, subsequent study of FIG. 2B however demonstrates in marked contrast how the special over/under graphic arrangement provides significantly improved human-engineering quality as to mind-eye visual-acuity, advantageously translating in a very normally perceived character of readability. For example, FIG. 2A tends to read "Cc-Aa-Tt", while FIG. 2B clearly reads "C-A-T" and "c-a-t" thereunder. Yet, there remain still other subtle, however critical differences which are to become more evident and understood as vital improvements. In FIG. 4 is exemplified how the diamond card configuration is heretofore being employed to no apparent advantage;—although even her, there appears clear advantage to the readability of the special over-and-under arrangement of the fonts.

Note that the reverse-sides of the playing cards are not shown in any of the drawings except FIG. 5, since the reverse-sides 28 all preferably exhibit an identical graphic-theme which is merely ornamental in nature offering no value. Other features represent in the playing-cards of FIG. 1 include preferred anterior-spaces 18/18' and surrounding posterior spaces 19, the anterior-spaces being preferable formed within readily identifiable variously color-coded interspatial card-suit outline delineations at 14/14' (exemplified as red), 15/15' (exemplified as blue), 16/16' (exemplified as green), 17/17' (exemplified as amber). These anterior-spaces 18/18' serve to exhibit the clue-picture or pictograph objects 20/20' which "picture-pairing" visual hints are considered vital to the learning functionality of the game. The common pictograph unit depicted here being an apple, giving hint as to the letter-font type, here being "A/a" for example;—and conversely, the picture of the noun "apple" hints to the learner that the letter-font sounded out phonically is an "A/a". Thus the phonics of individual letters can be learned with greater efficiency.

Note that the importance of vowels (a, e, i, o, u) to any game-plan possible herein, is limited only to their natural requirement in learning the fundamental forming of words; such as is necessary in the earlier described spelling oriented variant of this card game.

Study of FIG. 3 reveals how the preferred embodiment of FIG. 2B can be evolved still further as a generic-variant in the manner of uniform 4-point diamond playing-cards arranged so that their elongated imaginary bisecting-axis "X" are substantially vertically oriented, thereby stacking the relatively narrower lower-ends directly above one another so as to be uniquely convergent in V-formation at point 27. A significant human-engineering advancement is thereby discovered, which has not been demonstrated to have been anticipated by others, since the exceptionally compact cluster demonstrated in FIG. 3 enables a child to much more easily and securely hold a plurality of full-size playing-cards in their relatively diminutive hand. Here one may visually compare the ultimately tightly fanned-cluster of FIG. 3, with that fanned-cluster of the already substantially improved specimen of FIG. 2B. Notice also, how it is preferred that in any case the overall card-graphics are formatted unlike most conventional playing-cards, so that it is virtually impossible to have a playing-card appear to read upside-down. Moreover, it has been found that this novel modal of usage finds similar human-engineering advantage in use by adults as well as youngsters.

Reference to FIG. 5 exemplifies how the special playing-card deck may be adapted to play in the manner of various traditional card games.—For example, a basic Solitaire type card game layout is proposed and shown here in the midst of a game, wherein only four columns 21, 22, 23, 24, thus remain playable in place from the generally seven stacks having been presumed previously doled-out in the usual manner prior to one's initial play. The alphabet font sequencing is shown here progressing upward in stacks 21, 22, 23, 24 in descending order from "Z"-to-"A" in all the four left-hand columns, such as in the forth-column 24 from the left, which cards have read upper-to-lower "A-B-C-D", but presently read only "C-D". Accordingly, the player can relocate the "A"-card 26 in a special first/building-stack 25 over to the far right location, as to form a new reverse-sequence progression of playing-cards which oppositely stacks from "A(bottom)-Z(top)", provided the desired progression of playing-cards begin to become available during further play. Additionally, the procedure of relocating card array 21 upon array 22 will serve to uncover yet another concealed card. Should another "A"-card (appearing from the second suit originally shuffled into the deck) subsequently become thus uncovered, the player may ten start yet another second/building-stack to the next far-right space (not seen here). Were the player so lucky as to actually complete two such building-stacks A–Z, they would thereby win their solo-player game!

Interestingly, the important learning function of this game-plan, is to cause youngsters, or virtually anyone else needing to lean the so called "English alphabet", to engagingly work the proper sequence of alphabet letter,—both forward and backward.

Therefore, it is readily understood how the variant embodiments of this invention contemplate performing functions in a novel way not heretofore available nor contemplated. It is implicit that the utility of the foregoing adaptations of this invention are not necessarily dependent upon any prevailing invention patent; and, while the present invention has been well described herein before by way of certain illustrated embodiments, it is to be expected that various changes, alterations, rearrangements, and obvious modifications may be resorted to by those skilled in the art, without substantially departing from the implied spirit and scope. Therefore, the invention has been disclosed herein by way or example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

I claim:

1. A method of playing a card game employing a plurality of playing-cards imprinted with special alphabet learning indicia comprising the following steps:

forming a set of characters from A to Z represented individually upon two discrete suits of 26-cards apportioning into a deck of 52-cards;

each of said playing-cards having an identical conventional four cornered perimeter parallelogram configuration;

each of said playing-cards graphic format including a clue object pictograph portraying any familiar object which spelling begins with one of said set of characters, thereby serving to provide a player visual word association to that respective character;

each of said set of characters being formed on a respective playing-card in a first upper-case version, a second upper-case version, a first lower-case version, and second lower-case version;

said first upper-case version being formed at a first corner of said playing-card, said first lower-case version being formed at said first corner of said playing card and below said first upper case version;

said second upper-case version being formed at a second corner of said playing card, said second corner diagonally opposed to said first corner, said second upper-case version being inverted respective to said first upper-case version, said second lower-case version being formed at said second corner of said playing card and below said second upper-case version, said second lower-case version being inverted respective to said first lower-case version; and holding said playing-cards in hand vertically stacked with respect to a bottom-end of said playing-cards, said playing cards fan-clustered with respect to a top-end of said playing-cards, whereby either respective said first upper-case versions form a first character string laterally and respective said first lower-case versions form a second character string laterally or respective said second upper-case versions form a third character string laterally and respective said second lower-case versions form a fourth character string laterally.

2. The method of claim 1 further comprising the steps:

dealing of a plurality of playing cards to a plurality of players;

arranging a portion of said plurality of playing cards into at least one preselected sequence;

determining a number representing a quantity of said preselected sequence held by each of said plurality of players; and determining a winner of said game from said number by identifying one of said plurality of players having said number being larger than said number of all other said plurality of players.

3. The method of claim 2 wherein said preselected sequence is a pair of said plurality of playing-cards having said clue object being identical.

4. The method of claim 2 wherein said preselected sequence is a pair of said plurality of playing-cards having said character being identical.

5. The method of claim 1 wherein said clue object pictograph is an animal.

6. The method of claim 1 wherein said clue object pictograph is a fruit.

7. The method of claim 1 wherein said clue object pictograph is a vegetable.

8. The method of claim 1 wherein said clue object pictograph is a vehicle.

9. The method of claim 1 wherein said clue object pictograph is a musical instrument.

10. The method of claim 1 wherein said clue object pictograph is a planetary body.

11. A card game employing a plurality of playing-cards imprinted with special alphabet learning indicia, said playing-cards comprising:

a set of characters from A to Z represented individually upon two discrete suits of 26-cards apportioning into a deck of 52-cards;

each of said playing-cards having an identical conventional four cornered perimeter parallelogram configuration;

each of said playing-card graphic format including a clue object pictograph portraying any familiar object which spelling begins with one of said set of characters, thereby serving to provide player visual word association to that respective character;

each one of said set of characters being formed on a respective playing-card in a first upper-case version, a second upper-case version, a first lower-case version, and second lower-case version;

said first upper-case version being formed at a first corner of said playing-card, said first lower-case version being formed at said first corner of said playing-card and below said first upper case version; and said second upper-case version being formed at said second corner of said playing card, said second corner being diagonally opposed to said first corner, said second upper-case version being inverted respective to said first upper-case version, said second lower-case version being formed at said second corner of said playing card and below said second upper-case version, said second lower-case version being inverted respective to said first lower-case version.

12. The playing-cards of claim 11 wherein said clue object pictograph is a first clue object pictograph formed on said playing card, and further comprises a second clue object pictograph being formed on said playing-card, said second clue object pictograph being identical to said first clue object pictograph, said second clue object being formed inverted respective to said first clue object pictograph.

13. A card game employing a plurality of playing-cards imprinted with special alphabet learning indicia, said playing-cards comprising:

a set of characters from A to Z represented individually upon two discrete suits of 26-cards apportioning into a deck of 52-cards;

each of said playing-cards having an identical conventional four cornered perimeter parallelogram configuration;

said characters respectively formed in at least one corner of said playing cards;

each of said playing-cards graphic format including a first clue object pictograph portraying any familiar object which spelling begins with one of said set of characters, thereby serving to provide player visual word association to that respective character;

a second clue object pictograph being formed on said playing-card, said second clue object pictograph being identical to said first clue object pictograph formed on said-playing card, said second clue object being formed inverted respective to said first clue object pictograph.

14. The playing cards of claim 13 further comprising a first version and a second version of said character, said first version being formed in a first corner of said playing card, and said second version being formed in a second corner of said playing card, said second corner diagonally disposed with respect to said first corner, said second version inverted with respect to said first version.

* * * * *